United States Patent [19]

Dawson et al.

[11] 4,235,758

[45] Nov. 25, 1980

[54] CLEAR LIQUID DETERGENT COMPOSITION CONTAINING MGABS AND ALKYL POLYETHER SULPHATES

[75] Inventors: Peter L. Dawson, Upton-by-Chester; Edwin Willis, Wirral, both of England

[73] Assignee: Lever Brothers Company, New York, N.Y.

[21] Appl. No.: 972,155

[22] Filed: Dec. 21, 1978

[30] Foreign Application Priority Data

Dec. 22, 1977 [GB] United Kingdom ..... 53475/77

[51] Int. Cl.[3] ..... C11D 1/24; C11D 1/29; C11D 1/37; C11D 1/831

[52] U.S. Cl. ..... 252/544; 252/153; 252/173; 252/174.21; 252/541; 252/545; 252/551; 252/553; 252/558; 252/559; 252/DIG. 14

[58] Field of Search ..... 252/531, 534, 539, 540, 252/544, 545, 551, 553, 558, 559, 153, 173, 174.21, 174.22, DIG. 14, 541

[56] References Cited

U.S. PATENT DOCUMENTS

| | | | |
|---|---|---|---|
| 2,908,651 | 10/1959 | Grifo | 252/153 |
| 3,282,852 | 11/1966 | Trusler | 252/548 |
| 3,332,876 | 7/1967 | Walker | 252/551 X |
| 3,816,354 | 6/1974 | Steckler | 252/558 |
| 3,998,750 | 12/1976 | Payne | 252/108 |
| 4,129,515 | 12/1978 | Foster | 252/117 |

*Primary Examiner*—Dennis L. Albrecht
*Attorney, Agent, or Firm*—Michael J. Kelly; James J. Farrell; Melvin H. Kurtz

[57] ABSTRACT

A clear and stable concentrated liquid detergent composition which is effective especially for dishwashing in both hard and soft waters containing as active detergent component a mixture of:

(a) a magnesium alkylbenzene sulphonate derived from a linear $C_{10}$–$C_{13}$ alkylbenzene having an average molecular weight of from 220–250 and containing at least 3.5% by weight of dialkyl tetralin, and (b) an alkali metal, ammonium or amine alkyl polyether sulphate and/or a nonionic surfactant.

The liquid detergent composition has a clear point of below 20° C. and is exceptionally low temperature stable.

1 Claim, No Drawings

CLEAR LIQUID DETERGENT COMPOSITION CONTAINING MGABS AND ALKYL POLYETHER SULPHATES

This invention relates to clear liquid detergent compositions, particularly concentrated liquid detergent compositions suitable, but not exclusively, for use in dishwashing operations in both hard and soft water.

The invention also relates to a method of washing dishes utilising such detergent compositions.

The term "dishes" as used herein means utensils which may be required to be washed to free them from food particles and other food residues, greases, proteins, starches, gums, dyes, oils and burnt organic residues.

Light-duty liquid detergent compositions such as are suitable for use in washing dishes, are well known. Most of the formulations in commercial use at the present time are based on sodium and/or ammonium salts of anionic synthetic detergents with or without a nonionic surfactant, which, together with supplementary materials often employed give them satisfactory detergency and foaming properties. The major drawbacks of these detergent compositions, however, are that their performance in soft water is rather poor and that they cannot be formulated at higher active detergent matter concentrations without the use of excessively high levels of hydrotropes e.g. toluene or xylene sulphonates, urea and/or ethanol.

It has been suggested to add magnesium and/or calcium salts to detergent compositions to improve washing performance, especially under soft water conditions.

U.S. Pat. No. 2,908,651 describes the incorporation of magnesium chloride or magnesium sulphate in liquid detergent compositions containing an alkali metal or amine salt of an alkylaryl sulphonic acid and high proportions i.e. 15–33.3% of hydrotropes.

British Patent Specification No. 1,164,854 describes liquid detergent compositions comprising an alkylbenzene sulphonate, a nonionic surfactant and/or an alkylpolyether sulphate, hydrotropes and 0.5–10% by weight of an inorganic magnesium salt, e.g. magnesium sulphates as a viscosity controlling agent on dilution.

British Patent Specification No. 948,383 describes liquid detergent compositions containing up to 30% of active material and magnesium xylene or toluene sulphonate as solubiliser for improving the dishwashing performance in soft water.

French Patent Specification No. 1,233,047 describes the addition of up to 30% by weight of magnesium alkylaryl sulphonate to a mixture of sodium or triethanolamine alkylaryl sulphonate and an alkyl polyether sulphate to control the viscosity on dilution.

Netherlands Patent Application No. 7,607,160 describes a liquid detergent composition comprising a magnesium salt of a broad class of anionic sulphonate or sulphate detergents, a nonionic condensation product of ethylene oxide and a $C_8$–$C_{18}$ alcohol, hydrotropes and water.

Currently a great commercial interest is shown in more concentrated liquid detergent compositions, especially for dishwashing.

The advantages of highly concentrated liquids are evident, i.e. reduced transport and packaging costs, and smaller quantities of product needed by the consumer.

There are, however, several problems connected with the preparation of liquid detergent compositions containing high proportions of active detergent materials in order to satisfy certain requirements with respect to clarity, stability and viscosity of the product.

Generally it was found necessary to add a hydrotrope or a mixture of hydrotropes in fairly high proportions, especially to those detergent compositions in which the concentration of active detergent materials is quite appreciable. The hydrotrope has the effect of rendering the active detergent materials water-soluble and the composition homogeneous at those temperatures normally encountered during transport and storage of the compositions.

It is usual in the art to specify a "clear point" of liquid detergent compositions, this being the temperature at which a clear liquid composition, having been cooled to well below its point of stability and become cloudy, clears upon being allowed to slowly warm up again. The relationship of "clear point" to low temperature stability is complex in that, although the composition will always be isotropically stable at temperatures above the clear point, storage for relatively extended periods at temperatures 5°–10° C. below the clear point will not usually result in instability.

However, the lower the clear point, the better is the low temperature stability with less chance of liquid becoming cloudy on the shelf, a repulsive appearance to the consumer when the product is packed in transparent containers.

In formulating a concentrated liquid detergent composition it is desirable, for cost and performance reasons, to use only minimum amounts of expensive hydrotropes, which are generally only inactive materials, not contributing to detergency and washing performance.

Besides, hydrotropes being an ingredient, they will, like any other ingredient, occupy room in the composition and the more hydrotrope is added, the less room is available for the active detergent material, the consequence of which is that the maximum achievable active level is limited by exactly the presence of hydrotropes.

It is therefore an object of the present invention to provide a clear and stable concentrated liquid detergent composition, wherein the amount of hydrotropes or solubilisers required is minimised at any given level of active detergent material.

It is another object of the invention to provide a clear and stable liquid detergent composition which is effective especially for dishwashing in both hard and soft waters. A further object of the invention is to provide a clear aqueous liquid detergent composition containing 30–55%, preferably 35–55% by weight of an active detergent mixture, showing improved stability at lower temperatures.

These and other objects which will be apparent hereinafter can be achieved by using a magnesium salt of an alkylbenzene sulphonic acid derived from a linear $C_{10}$–$C_{13}$ alkylbenzene having an average molecular weight of about 220–250, and containing at least 3.5% by weight of dialkyl tetralin, in conjunction with an alkali metal, ammonium or amine salt of an alkylpolyether sulphuric acid and/or a nonionic surfactant.

Commercial linear alkylbenzenes are made by two major catalytic processes, i.e. $AlCl_3$ and HF alkylation. Depending on the type of alkylating process, they contain more or less of cyclic impurities of which dialkyl tetralins are the most important component.

It is generally considered that the cyclic compounds are formed from difunctional materials found in the alkylating feedstock, i.e. dichloro paraffins in the benzene/chloroparaffin/$AlCl_3$ alkylation process, or diolefins in the benzene/olefins/HF alkylation process, though on comparing alkylates obtained from these two process routes the levels of cyclic impurities in alkylates made by the benzene/chloroparaffin/$AlCl_3$ route are generally higher.

Hence, depending on the process utilised during alkylate manufacture, either significant quantities or hardly any dialkyl tetralins are formed. Commercially available alkylbenzenes contain anything from practically zero to about 10–15% tetralin, the lower tetralin samples sometimes being claimed as being superior for efficiency and colour.

It has now been found that the high tetralin alkylbenzenes, provided their molecular weights are within the range of 220–250, are extremely suitable for use as raw material for the purpose of the present invention. It should be appreciated that low tetralin alkylbenzenes of the same molecular weight range can also be made suitable by increasing the dialkyl tetralin up to at least 3.5%.

Preferred linear alkylbenzene sulphonates are those which are derived from alkylbenzenes having an average molecular weight of 225–245 and containing at least 4% by weight of dialkyl tetralin, which can be measured by using $^{13}C$-NMR techniques.

The dialkyl tetralin present in the alkylbenzene or the corresponding dialkyl tetralin sulphonate present in the alkylbenzene sulphonates used in the present invention has usually the same total number of carbon atoms as the bulk of the alkylbenzene or alkylbenzene sulphonate used, though a variation of $\pm 3$ would be tolerable.

Suitable alkali metal, ammonium or amine salts of an alkyl polyether sulphuric acid which can be used in the present invention are primary or secondary alcohol ethoxy sulphates which may be represented by the general formula $R—(C_2H_4O)_nOSO_3M$, in which R represents an alkyl group having 10–18 carbon atoms, preferably 11–15 carbon atoms, n is an integer of from 1 to 8, preferably 1 to 5, and M represents an alkali metal atom, an ammonium radical or a substituted ammonium radical e.g. monoethanolamine.

Suitable nonionic surfactants which can be used in the present invention are (1) nonionic alkylphenol polyethers of the general formula $R—C_6H_4—O—(C_2H_4O)_nH$, where R is an alkyl group having from 6–16 carbon atoms, preferably 8–12 carbon atoms, and n is an integer of from 8 to 16, preferably 9–12;

(2) nonionic condensates of fatty acids and ethylene oxide of the general formula $R—CO—O—(C_2H_4O)_nH$, where R is an alkyl group having from 12–18 carbon atoms, and n is an integer of from 8–16; and (3) nonionic condensates of straight or branched chained, primary or secondary alcohols and ethylene oxide of the general formula $R—O—(C_2H_4O)_nH$, where R is an alkyl group having 10–20 carbon atoms and n is an integer of from 8–20.

Accordingly the invention provides a clear and stable liquid detergent composition, useful particularly but not exclusively for dishwashing in hard and soft water, containing 30–55% by weight of an active detergent mixture comprising (a) magnesium alkylbenzene sulphonate derived from a linear $C_{10}$–$C_{13}$ alkylbenzene of average molecular weight of 220–250 and containing at least 3.5% by weight of dialkyl tetralin, and (b) an alkali metal, ammonium or amine alkylpolyether sulphate and/or a nonionic surfactant.

Advantageously the ratio of alkylbenzene sulphonate to alkylpolyether sulphate and/or nonionic surfactant present in the composition of the invention is from 1:1 to 5:1 by weight.

Though use of lower ratios than 1:1 (i.e. an excess of second active component over the alkylbenzene sulphonate) is possible, it is not preferred since the dishwashing performance could begin to fall off. For foam profile reasons, mixtures of alkylbenzene sulphonate and alkylpolyether sulphates are preferred to mixtures of alkylbenzene sulphonates and nonionic surfactants.

As explained above, the use of this specific type of magnesium alkylbenzene sulphonate makes it possible to reduce the hydrotrope requirements significantly at any given level of active detergent material, leaving room for more active detergents in the composition. In this way the practical upper limit can be raised to a content of about 55% by weight of active material with appreciably smaller amounts of inert hydrotropes.

Generally the amount of hydrotrope present in the composition of the invention will be in the range of from substantially zero increasing to a maximum of about 12% by weight at increasing levels of active detergent material in the composition.

Preferred hydrotropes are lower alcohols containing 2–4 carbon atoms and urea, each of which can be used alone or in combination.

The liquid detergent composition of the invention can be conveniently prepared by dissolving the active detergent materials with the required amount of hydrotropes in water.

The magnesium alkylbenzene sulphonate may be prepared in situ during the preparation of the liquid by neutralising alkylbenzene sulphonic acid with a basic magnesium salt such as the oxide, hydroxide or carbonate. Although it is preferred to fully neutralise the acid with a basic magnesium salt, partial neutralisation may be effected with other bases such as sodium hydroxide, ammonium hydroxide or an organic amine. In such cases, the final formulations should contain a level of magnesium ions equivalent to at least 50%, preferably at least 75%, of the total detergent anions. Preferably the pH of the formulations should not exceed 7.8, since otherwise precipitation of magnesium hydroxide would occur.

Hence the active detergent mixture in the composition of the invention may comprise a magnesium alkylbenzene sulphonate and an alkali metal or ammonium alkylbenzene sulphonate wherein the proportion of magnesium alkylbenzene sulphonate is predominating. Calcium alkylbenzene sulphonate is less suitable and cannot therefore be used in the present composition to replace wholly the magnesium alkylbenzene sulphonate, though minor amounts not affecting the solubility properties may be present.

The composition of the invention may furthermore contain, as desired, minor amounts of other ingredients normally used in liquid dishwashing compositions as well as of special additives for achieving special effects without departing from the essence of the invention. Such ingredients and special additives which can be incorporated are for example sequestering agents such as sodium citrate; lather-promoting agents such as coconut fatty acid diethanolamide; proteins and modified proteins for improved drain-dry and mildness properties such as casein, gelatin and their derivatives; organic phosphonates and phosphate esters known to improve rinsability and shine of aluminium surfaces; preservatives; germicides; perfumes and colouring agents.

The invention makes it possible to prepare liquid detergent compositions containing 30–55% by weight of total active detergent materials in the form of clear and stable liquids of viscosities in the range of 50–800 cS, preferably 100–400, and clear points of below 20° C., preferably below 10° C.

The following Examples will illustrate the invention.

EXAMPLE 1

This Example demonstrates the effect of alkylate molecular weight and dialkyl tetralin content on the physical properties of liquid detergent compositions containing 40% by weight of total active matter consisting of a 4:1 mixture by weight of magnesium linear alkylbenzene sulphonate ($MgABS_2$) and ammonium $C_{12-15}$-alkyl(ethyleneoxide)$_3$-sulphate together with 4% of ethanol.

| Mg $ABS_2$ from ABS sample No. | Average mol. wt. of alkylate | % dialkyl tetralin | clear point ° C. | viscosity* at 25° cS |
|---|---|---|---|---|
| 1 | 233 | 4.6 | 16 | 250 |
| 2 | 245 | 1.0 | 40 | — |
| 3 | 238 | 0 | 38 | — |
| 4 | 242 | 0 | 34 | — |
| 5 | 242 | 10.0 | 6 | 440 |
| 6 | 242 | 5.0 | 18 | 300 |
| 7 | 237 | 2.3 | 42 | — |
| 8 | 233 | 4.5 | 6 | 370 |

The above results show that samples Nos. 2, 3, 4 and 7 with dialkyl tetralin contents below 3.5% have high clear points in the range of 34°–42° C. Alkylbenzene sulphonates of samples 1, 5,6 and 8 with tetralin contents above 3.5% have significantly lower clear points in the range of 6°–18° C.

EXAMPLE 2

This Example demonstrates the easier hydrotroping of a liquid detergent composition of the invention over a liquid composition outside the invention.

A 42% total active matter composition based on 2:1 (by weight) mixture of linear alkylbenzene sulphonate (ABS) and alkylether sulphate using ABS derived from alkylate of mol. wt. 233 and having a tetralin content of 4.6%, required the following hydrotrope levels to give a clear point of 0° C. and a viscosity at 25° C. of about 150° cS.

| Composition: | |
|---|---|
| Sodium alkylbenzene sulphonate<br>$NH_4$ alkylether sulphate | 5% ethanol +<br>5% urea |
| Magnesium alkylbenzene sulphonate<br>$NH_4$ alkylether sulphate | 5% ethanol |

EXAMPLE 3

| Composition | % |
|---|---|
| Mg-alkylbenzene sulphonate (M.W. 233; tetralin 4.6) | 26.5 |
| $NH_4$—$C_{12-15}$-alkyl-3EO-sulphate | 26.5 |
| Ethanol | 6 |
| Urea | 3 |
| Water + preservatives | to 100 |
| Clear point: 18° C. | |
| Viscosity : 400 cS at 25° C. | |

EXAMPLE 4

| Composition: | % |
|---|---|
| Mg-alkylbenzene sulphonate (M.W. 242; tetralin 10%) | 32 |
| $NH_4$—$C_{12-15}$-alkyl-3EO-sulphate | 16 |
| Ethanol | 9 |
| Water | to 100 |
| Clear point: 5° C. | |
| Viscosity : 120 cS at 25° C. | |

EXAMPLE 5

| Composition: | % |
|---|---|
| Mg-alkylbenzene sulphonate (M.W. 242; tetralin 10%) | 32 |
| Na-lauryl-3EO-sulphate | 8 |
| Ethanol | 4 |
| Water, perfume, colour | 100 |
| Clear point: 11° C. | |
| Viscosity : 400 cS at 25° C. | |

EXAMPLE 6

| Composition: | % |
|---|---|
| Mg-alkylbenzene sulphonate (M.W. 233; tetralin 4.6) | 21 |
| $NH_4$—$C_{12-15}$-alkyl-3EO-sulphate | 21 |
| Ethanol | 1 |
| Urea | 1 |
| Water | to 100 |
| Clear point: 0° C. | |
| Viscosity : 390 cS. | |

All liquid compositions of Examples 3–6 exhibit satisfactory stability and viscosity properties and outstanding conventional performance in all types of naturally occurring water.

EXAMPLE 7

| Composition: | % |
|---|---|
| Mg-alkylbenzene sulphonate | 30 |
| $C_{12-15}$-alcohol ethoxylate (11 ethylene oxide) | 10 |
| Ethanol | 5 |
| Water | to 100 |

The above composition was prepared using alkylbenzene sulphonate derived from linear alkylbenzenes of the following specifications. The clear point of each composition was measured.

| | Mol.wt. | Tetralin content | Clear point |
|---|---|---|---|
| (1) | 242 | 10% | −6° C. |
| (2) | 233 | 4.6% | −6° C. |
| (3) | 238 | 0% | +10° C. |

Samples (1) and (2) with a high tetralin content have significantly lower clear points for a given level of hydrotrope as compared with sample (3) with zero tetralin content.

EXAMPLE 8

| Composition B: | Composition A |
|---|---|
| 30% Mg-linear alkylbenzene sulphonate (M.W. 242; tetralin 10%) | 30% Na-linear alkylbenzene sulphonate (M.W. 242; tetralin 10%) |
| 10% nonionic surfactant ($C_{12-15}$-alcohol ethoxylate-11EO) | 10% nonionic surfactant ($C_{12-15}$-alcohol ethoxylate-11EO) |
| 5% Ethanol | 5% Ethanol |
| Water to 100% | Water to 100% |
| Clear point: −6° C. | Clear point: +22° C. |

The magnesium salt had a clear advantage over the sodium salt, in terms of product stability for a given level of hydrotrope.

EXAMPLE 9

Three compositions comprising 4:1 ratio of $MgABS_2$ and $C_{12-15}$ alkylether sulphate 0.3EO+5% ethanol were prepared using linear alkylbenzene sulphonates of varying molecular weights. Each composition was tested at an active level of 0.06% for dishwashing performance measured as number of plates washed using the standard platewashing test.

| | Alkylbenzene | | | Number of plates washed in | |
|---|---|---|---|---|---|
| | Mol. wt. | Tetralin content | Stability | 5° H. water | 24° H. water |
| Composition 9 | 237 | 4.5% | Clear point 16° C. | 50 | 40 |
| Composition B | 257 | 4.5% | Cloudy at room temp. | 22 | 20 |
| Composition C | 262 | 8.0% | Cloudy at room temp. | 35 | 15 |

Composition 9 within the invention is significantly superior to Compositions B and C outside the invention.

We claim:

1. A clear, stable liquid detergent composition having a clear point below 20° C. consisting of:

a. 35 to 55 percent by weight of said composition of a detergent mixture consisting of:

(i) a magnesium alkylbenzene sulphonate derived from a linear $C_{10}$–$C_{13}$ alkylbenzene having an average molecular weight of from 225 to 245 and containing at least 4 percent by weight of said sulphonate of dialkyl tetraline, and (ii) an alkali metal, ammonium or amine alkyl polyethersulphate having the general formula $$R—(C_2H_4O)_n—OSO_3M$$

where R is an alkyl group of 10 to 18 carbon, n is an integer from 1 to 8, and M is an alkali metal, ammonium or amine cation wherein said magnesium alkylbenzene sulphonate and said alkyl polyethersulphate are present in a ratio of 1:1 to 5:1, b. 0 to 12 percent by weight of said composition of a hydrotrope selected from the group consisting of lower alcohols having 2 to 4 carbon atoms, urea, and mixtures thereof; and c. water.

* * * * *